US008517123B2

(12) United States Patent
Reese

(10) Patent No.: US 8,517,123 B2
(45) Date of Patent: Aug. 27, 2013

(54) MILLING CAP FOR A POLYCRYSTALLINE DIAMOND COMPACT CUTTER

(75) Inventor: Michael R. Reese, Houston, TX (US)

(73) Assignee: Varel International, Ind., L.P., Carrollton, TX (US)

( * ) Notice: Subject to any disclaimer, the term of this patent is extended or adjusted under 35 U.S.C. 154(b) by 402 days.

(21) Appl. No.: 12/787,349

(22) Filed: May 25, 2010

(65) Prior Publication Data

US 2010/0319996 A1 Dec. 23, 2010

Related U.S. Application Data

(60) Provisional application No. 61/182,382, filed on May 29, 2009.

(51) Int. Cl.
*E21B 10/55* (2006.01)
*E21B 12/04* (2006.01)

(52) U.S. Cl.
USPC ..... 175/307; 175/434; 175/435

(58) Field of Classification Search
USPC ..... 175/435, 434, 379, 426, 425, 307; 76/108.2, 108.4
See application file for complete search history.

(56) References Cited

U.S. PATENT DOCUMENTS

| | | | | |
|---|---|---|---|---|
| 1,970,761 | A | | 8/1934 | McVicar |
| 2,136,748 | A | | 11/1938 | Lottinger |
| 2,196,528 | A | | 4/1940 | Hughes |
| 2,207,920 | A | | 7/1940 | Hughes |
| 2,215,913 | A | | 9/1940 | Brown |
| 2,331,293 | A | | 10/1943 | Ballard |
| 2,334,746 | A | | 11/1943 | Brantly |
| 2,357,330 | A | | 9/1944 | Hyer |
| 2,492,794 | A | | 12/1949 | Goble et al. |
| 2,493,178 | A | | 1/1950 | Williams, Jr. |
| 2,495,439 | A | | 1/1950 | Brimble |
| 2,642,267 | A | | 6/1953 | Zublin |
| 2,644,672 | A | * | 7/1953 | Mathews ..... 175/307 |
| 2,658,284 | A | | 11/1953 | Arps |
| 2,669,429 | A | | 2/1954 | Zublin |
| 2,708,105 | A | | 5/1955 | Williams, Jr. |
| 2,869,825 | A | | 1/1959 | Crawford |
| 3,266,577 | A | | 8/1966 | Turner |
| 3,536,150 | A | | 10/1970 | Stebley |
| 4,101,318 | A | | 7/1978 | Rudy |

(Continued)

FOREIGN PATENT DOCUMENTS

| | | |
|---|---|---|
| EP | 0418706 A1 | 3/1991 |
| GB | 1153988 A | 6/1969 |

OTHER PUBLICATIONS

PCT International Preliminary Report on Patentability and Written Opinion mailed Dec. 8, 2011 for PCT/US2010/036466 (8 pages).

(Continued)

*Primary Examiner* — Kenneth L Thompson
(74) *Attorney, Agent, or Firm* — Gardere Wynne Sewell LLP; Andre M. Szuwalski

(57) ABSTRACT

A PDC cutter includes a diamond table layer and an underlying substrate layer. A cap structure for the PDC cutter includes a first portion overlying, but not attached to, a front face of the diamond table layer and a second portion extending perpendicularly from the first portion which is overlying and attached to an outer peripheral surface of the underlying substrate layer.

31 Claims, 4 Drawing Sheets

(56) References Cited

U.S. PATENT DOCUMENTS

| | | | | |
|---|---|---|---|---|
| 4,351,401 | A | 9/1982 | Fielder | |
| 4,382,477 | A * | 5/1983 | Barr | 175/428 |
| 4,478,298 | A * | 10/1984 | Hake et al. | 175/432 |
| 4,605,343 | A | 8/1986 | Hibbs, Jr. et al. | |
| 4,623,025 | A | 11/1986 | Verstraeten | |
| 4,696,354 | A | 9/1987 | King et al. | |
| 4,714,120 | A | 12/1987 | King | |
| 4,794,986 | A | 1/1989 | Langer | |
| 4,815,342 | A | 3/1989 | Brett et al. | |
| 4,823,892 | A | 4/1989 | Fuller | |
| 4,869,330 | A | 9/1989 | Tibbitts | |
| 4,889,017 | A | 12/1989 | Fuller et al. | |
| 4,956,238 | A | 9/1990 | Griffin | |
| 5,042,596 | A | 8/1991 | Brett et al. | |
| 5,090,492 | A | 2/1992 | Keith | |
| 5,127,923 | A | 7/1992 | Bunting et al. | |
| 5,244,039 | A | 9/1993 | Newton, Jr. et al. | |
| 5,259,469 | A | 11/1993 | Stjernstrom et al. | |
| 5,330,016 | A | 7/1994 | Paske et al. | |
| 5,346,025 | A | 9/1994 | Keith et al. | |
| 5,358,026 | A | 10/1994 | Simpson | |
| 5,441,121 | A | 8/1995 | Tibbitts | |
| 5,549,171 | A | 8/1996 | Mensa-Wilmot et al. | |
| 5,551,522 | A | 9/1996 | Keith et al. | |
| 5,582,261 | A | 12/1996 | Keith et al. | |
| 5,651,421 | A | 7/1997 | Newton et al. | |
| 5,797,455 | A | 8/1998 | Barron et al. | |
| 5,826,651 | A | 10/1998 | Lee et al. | |
| 5,887,668 | A | 3/1999 | Haugen et al. | |
| 5,979,571 | A | 11/1999 | Scott et al. | |
| 6,039,127 | A | 3/2000 | Myers | |
| 6,062,326 | A | 5/2000 | Strong et al. | |
| 6,063,502 | A | 5/2000 | Sue et al. | |
| 6,138,756 | A | 10/2000 | Dale | |
| 6,145,607 | A * | 11/2000 | Griffin et al. | 175/426 |
| 6,298,930 | B1 | 10/2001 | Sinor et al. | |
| 6,401,820 | B1 | 6/2002 | Kirk et al. | |
| 6,439,326 | B1 | 8/2002 | Huang et al. | |
| 6,443,247 | B1 | 9/2002 | Wardley | |
| 6,460,631 | B2 | 10/2002 | Dykstra et al. | |
| 6,464,002 | B1 | 10/2002 | Hart et al. | |
| 6,510,906 | B1 | 1/2003 | Richert et al. | |
| 6,568,881 | B2 | 5/2003 | Long | |
| 6,612,383 | B2 | 9/2003 | Desai et al. | |
| 6,612,384 | B1 | 9/2003 | Singh et al. | |
| 6,620,308 | B2 | 9/2003 | Gilbert | |
| 6,655,481 | B2 | 12/2003 | Findley et al. | |
| 6,659,173 | B2 | 12/2003 | Kirk et al. | |
| 6,702,045 | B1 | 3/2004 | Elsby | |
| 6,725,939 | B2 | 4/2004 | Richard | |
| 6,817,633 | B2 | 11/2004 | Brill et al. | |
| 6,845,816 | B2 | 1/2005 | Kirk et al. | |
| 6,848,517 | B2 | 2/2005 | Wardley | |
| 7,066,253 | B2 | 6/2006 | Baker | |
| 7,096,982 | B2 | 8/2006 | McKay et al. | |
| 7,117,960 | B2 | 10/2006 | Wheeler et al. | |
| 7,216,727 | B2 | 5/2007 | Wardley | |
| 7,322,776 | B2 | 1/2008 | Webb et al. | |
| 7,395,882 | B2 | 7/2008 | Oldham et al. | |
| 7,426,969 | B2 * | 9/2008 | Azar | 175/426 |
| 7,757,793 | B2 * | 7/2010 | Voronin et al. | 175/435 |
| 7,998,573 | B2 * | 8/2011 | Qian et al. | 428/325 |
| 8,074,749 | B2 | 12/2011 | Twardowski et al. | |
| 2002/0170713 | A1 | 11/2002 | Haugen et al. | |
| 2004/0108739 | A1 | 6/2004 | Beeman et al. | |
| 2004/0188141 | A1 | 9/2004 | Slaughter et al. | |
| 2004/0226751 | A1 | 11/2004 | McKay et al. | |
| 2004/0228694 | A1 | 11/2004 | Webb et al. | |
| 2004/0244540 | A1 | 12/2004 | Oldham et al. | |
| 2004/0245020 | A1 | 12/2004 | Giroux et al. | |
| 2005/0103530 | A1 | 5/2005 | Wheeler et al. | |
| 2005/0145417 | A1 | 7/2005 | Radford et al. | |
| 2006/0070771 | A1 | 4/2006 | McClain et al. | |
| 2006/0124706 | A1 | 6/2006 | Raybould et al. | |
| 2007/0131459 | A1 | 6/2007 | Voronin et al. | |
| 2007/0175671 | A1 | 8/2007 | Nava | |
| 2007/0175672 | A1 * | 8/2007 | Eyre et al. | 175/426 |
| 2007/0187149 | A1 | 8/2007 | Kristensen et al. | |
| 2007/0193782 | A1 | 8/2007 | Fang et al. | |
| 2007/0246224 | A1 | 10/2007 | Krauss et al. | |
| 2007/0261890 | A1 | 11/2007 | Cisneros | |
| 2007/0277651 | A1 | 12/2007 | Calnan et al. | |
| 2007/0278017 | A1 * | 12/2007 | Shen et al. | 175/426 |
| 2007/0289782 | A1 | 12/2007 | Clark et al. | |
| 2008/0149398 | A1 | 6/2008 | Azar | |
| 2008/0187403 | A1 | 8/2008 | Ertl et al. | |
| 2009/0078470 | A1 | 3/2009 | Lyons et al. | |
| 2009/0120693 | A1 | 5/2009 | McClain et al. | |
| 2009/0255664 | A1 | 10/2009 | Hart et al. | |
| 2010/0051349 | A1 | 3/2010 | Ballard et al. | |
| 2010/0166592 | A1 | 7/2010 | Uno et al. | |
| 2010/0282519 | A1 | 11/2010 | Zhang et al. | |
| 2010/0307837 | A1 | 12/2010 | King et al. | |
| 2011/0061941 | A1 | 3/2011 | Twardowski et al. | |
| 2011/0259604 | A1 | 10/2011 | Oldham et al. | |
| 2011/0259605 | A1 | 10/2011 | Oldham et al. | |
| 2011/0259606 | A1 | 10/2011 | Oldham et al. | |
| 2011/0259608 | A1 | 10/2011 | Oldham et al. | |
| 2011/0259643 | A1 | 10/2011 | Oldham et al. | |
| 2011/0266069 | A1 | 11/2011 | Oldham et al. | |
| 2012/0103694 | A1 | 5/2012 | Twardowski et al. | |

OTHER PUBLICATIONS

Sinor, Allen: "Casing Drilling—Recent Advances for Drilling Challenges," Hughes Christensen—A Baker Hughes Company, The Woodlands, TX, SPE Gulf Coast Section Jan. 10, 2001 (34 pages).

Office Action mailed Oct. 13, 2006 for U.S. Appl. No. 10/783,720 (27 pages).

Office Action mailed Apr. 20, 2006 for U.S. Appl. No. 10/783,720 (32 pages).

Tarr, Brian, et al.: "Casing-while-Drilling: The Next Step Change in Well Construction," Published in World Oil, Oct. 1999 issue (10 pages).

Sinor, L.A., et al.: "Rotary Liner Drilling for Depleted Reservoirs," IADC/SPE 39399, Mar. 3-6, 1998 (10 pages).

Galloway G.: "Rotary Drilling with Casing—A field proven method of reducing wellbore construction cost," World Oil Casing Drilling Technical Conference, Mar. 6-7, 2003 (7 pages).

McKay, D., et al.: "New Developments in the Technology of Drilling with Casing: Utilizing a Displaceable DrillShoe Tool," World Oil Casing Drilling Technical Conference, Mar. 6-7, 2003 (11 pages).

Hughes Christensen, "Reduce Risk, Ensure your casing gets to total depth", EZReam, Baker Hughes Inc, 2007 (4 pages).

"DrillShoe III, Drilling with Casing", Weatherford International Ltd., 2005-2008 (4 pages).

"DrillShoe II, 5-Blade Models, Drilling with Casing", Weatherford International Ltd., 2008 (4 pages).

"DrillShoe II, 4-Blade Models, Drilling with Casing", Weatherford International Ltd., 2005-2007 (4 pages).

PCT International Search Report and Written Opinion cited in Application No. PCT1US20101036466, dated Aug. 4, 2010 (9 pages).

* cited by examiner

MILLING CAP FOR A POLYCRYSTALLINE DIAMOND COMPACT CUTTER

PRIORITY CLAIM

This application claims priority from U.S. Provisional Patent Application No. 61/182,382 filed May 29, 2009, the disclosure of which is incorporated by reference.

CROSS REFERENCE TO RELATED APPLICATIONS

This application is related to U.S. Provisional Patent Application Nos. 61/184,635 filed Jun. 5, 2009 (now U.S. patent application Ser. No. 12/793,489, filed Jun. 3, 2010) and 61/182,442 filed May 29, 2009 (now U.S. application Ser. No. 12/789,416, filed May 27, 2010), the disclosures of which are incorporated by reference.

TECHNICAL FIELD

The present invention relates generally to earth boring bits, and more particularly to polycrystalline diamond compact (PDC) drill bits. The present invention further concerns drill bits which support both a milling capability and a formation drilling capability.

BACKGROUND

The diamond layers of PDC drill bit cutters are extremely wear and abrasion resistant but can readily suffer chipping when exposed to impact or high point loading during shipping, handling, and running into the wellbore. The cutters are also susceptible to diamond graphitization at the cutting tip due to a chemical reaction with ferrous materials at high frictional temperatures produced during cutting when ferrous materials are encountered, such as in the drilling out of casing windows or the drilling out of casing-associated equipment. Other materials, such as tungsten carbide, or cubic boron nitride (CBN), are better at cutting ferrous materials but are not as effective at cutting rock that is encountered for instance after casing or casing-associated components have been drilled through. For the purposes of this disclosure, "casing-associated component" is meant to include, but is not limited to, the following: stage cementing equipment, float shoes, shoe tracks, float collars, float valves, wipers, activation darts, activation balls, inflatable packers, mechanical packers, swellable packers, circulation subs, casing shoes, casing bits, reamer shoes, guide reamers, liner guides, liner bits, motor driven shoes, motor driven reamers, motor driven bits, disposable or one-trip motors, and disposable or one-trip turbines. In other words, a "casing-associated component" is defined as any deployed or installed obstruction within a well bore casing, or mounted within, at, or outside the end of the casing, that may be encountered in whole or in part by a drill bit.

Historically, ferrous materials associated with casing-associated components were drilled out with a specialty bit or milling tool before the preferred bit for the formation application was tripped into the hole. The potential cost savings in trip time of having a bit that could effectively drill through the casing or casing-associated equipment drove the development of new combination bits oftentimes referred to as mill drills. Bits in this area of art are typically called upon to drill between 1 and 35 linear feet of casing or casing-associated components. In the instance of casing window milling the tools must remove a few lateral inches of casing wall thickness while drilling down several linear feet. In casing exit milling, the distance to be drilled through the casing wall is dependent on the configuration and slope angle of the whipstock that is used to push the bit into the casing wall. In both cases, the relatively short amount of drilling of the casing or casing-associated equipment occurs prior to being called upon to drill hundreds or even several thousands of feet of formation.

Prior art efforts to provide for solutions to cutter protection and/or casing and casing-associated component milling, and subsequent formation drilling are set forth below. All references discussed herein are incorporated by reference.

U.S. Pat. No. 4,397,361 to Langford describes abradable cutter protection afforded by individual protrusions projecting from the head portion of the bit more than the extension of the PDC cutting elements. These protrusions are fabricated of a metal more readily abraded by the earth formation than any of the cutting elements.

U.S. Pat. Nos. 4,995,887 and 5,025,874 to Barr et al describe PDC cutters which have an additional layer of tungsten carbide bonded to the face of the diamond layer. This bonding is achieved in a high temperature, high pressure press. What is described are "cutting elements in which a further front layer of less hard material, usually again tungsten carbide, is bonded to the front face of the diamond layer and extends across at least the major part thereof. Since the less hard material of the further layer may have better toughness in tension than the diamond layer, this may enable the cutting element better to resist tensile stress. . . . " The drawbacks of this approach are discussed herein under.

U.S. Pat. No. 5,979,571 to Scott et al describes a "Combination Milling Tool and Drill Bit". In the Scott approach, tungsten carbide inserts are mounted in an outward row on a blade that extends from the main body of the drill bit. The outward mounted tungsten carbide inserts attached to the outward projecting portion of a blade are meant to protect an underlying row of PDC inserts connected to the same blade. Alternatively, a more outwardly projecting blade carrying tungsten carbide inserts acts to protect a less outwardly projecting blade carrying PDC inserts. In either case, the parent blade material of the combined blade or of the separate blades will create a bearing area after the tungsten carbide cutters have worn away. In another embodiment, a tungsten carbide layer is pressed in a high pressure/high temperature press onto the face of the PDC cutters. The drawbacks of this approach are discussed herein under. In another embodiment PDC cutters are embedded in the center of a ring of protective tungsten carbide insert material. In the case where the cutters are embedded in a ring of tungsten carbide the face of the PDC portion of the cutters is fully exposed and unprotected from metal debris encountered during drill out. In addition, as the combined element enters formation and the tungsten carbide ring begins to wear, bearing areas of tungsten carbide co-exist with and are adjacent to the PDC diamond layer throughout the life of the bit. In addition, the surrounding rings of tungsten carbide either reduce the total number of cutters that can be placed on a blade or overall bit face, or they reduce the diameter of the PDC diamond layers available for formation cutting. Either of these choices represents compromising departures from standard PDC bit designs.

U.S. Pat. No. 5,887,668 to Haugen et al describes milling bits with a sacrificial nose cone beneath the bit, a cutting structure intended to mill a window, and in some embodiments a cutting structure intended to drill ahead in formation. The bits described by Haugen are purpose built for these operations.

U.S. Pat. No. 6,612,383 to Desai et al describes a dual function drag bit using PDC cutters faced with a bonded tungsten carbide layer. These cutters are described as being made in a high temperature/high pressure press. The drawbacks of this approach are discussed herein under.

U.S. Pat. No. 7,178,609 to Hart et al describes a Window Mill and Drill Bit that uses separate blades or cutter sets of primary cutting structure for milling and secondary blades or cutter sets for formation drilling. In addition, Hart describes an attachment method whereby the Mill is attached to a whipstock boss using a shear bolt that directly attaches to a threaded socket deployed in a purpose built relief area on the working face of the mill.

U.S. Patent Application Publication No. 2006/0070771 to McClain et al describes Earth Boring Drill Bits with Casing Component Drill Out Capability and Methods of Use. Cutting elements aimed at cutting through wellbore equipment are deployed in separate, more highly exposed sets than cutters aimed at drilling the formation.

U.S. Patent Application Publication No. 2007/0079995 to McClain et al describes Cutting Elements Configured for Casing Component Drillout and Earth Boring Drill Bits Including Same. FIGS. 7A and 7B of the '995 application show a bonded cutter wherein the leading superabrasive element is bonded to a backing abrasive element that protrudes beyond the top of the circular, leading superabrasive element.

U.S. Patent Application Publication No. 2008/0308276 to Scott points out that "One drawback associated with providing two sets of cutting elements on a drill bit . . . is an inability to provide an optimum cutting element layout for drilling the formation after penetration of casing or casing components and surrounding cement. This issue manifests itself not only in problems with attaining an optimum cutting action, but also in problems, due to the presence of the required two sets of cutting elements, with implementing a bit hydraulics scheme effective to clear formation cuttings using a drilling fluid when any substantial rate of penetration (ROP) is sought." Scott's solution to the drawback is to provide the drill bit with cutters configured (via coating, deposition, or HPHT bonding) with a non-reactive superabrasive material, such as cubic boron nitride, overlaying or deployed with traditional diamond cutting material, such as PDC. In other words the solution requires specialized, non-traditional PDC cutters. The solution cannot be retrofitted into a standard PDC bit but rather must be substituted for standard PDC cutters.

To broadly summarize, the solutions proposed in the prior art in this area fall into two categories: 1) Make an additional standalone structure (including separate sockets, mounting, blades, and or pre-bonded elements) of overexposed metal (typically tungsten carbide) elements to protect the primary PDC cutters in an axial direction and/or accomplish the initial milling task. In these instances the superabrasive elements can be removed from the bit and a standalone cutting structure will remain. 2) Make special PDC cutters faced with bonded (typically via HPHT methods) tungsten carbide or other non-diamond material that can accomplish the milling task prior to the traditional diamond, typically PDC, coming into play to cut the formation.

These solutions need to be evaluated in light of the body of knowledge that exists in the PDC drill bit art. Some key points are as follows:

- It has been demonstrated that even slight rounding of the PDC cutter edges can reduce rate of penetration in a significant and adverse manner in many formations.
- It has been demonstrated that PDC is superior to tungsten carbide, and cubic boron nitride (CBN) or other superabrasive materials for formation drilling.
- It has been demonstrated that inefficient cleaning and cooling of the bit adversely affects penetration rate and bit life.
- It has been demonstrated that non-formation cutting elements that come in contact with the rock face generate heat and limit penetration rate by setting up non-cutting load bearing areas of the bit face.
- It has been demonstrated that force balanced PDC drill bits last longer and perform better than non-force balanced PDC drill bits.
- It has been demonstrated that any type of thermal insulation of the cutting tip can accelerate the wear rate and thermal deterioration of the PDC diamond. Reference is made to SPE 16699 Sinor and Warren "Drag Bit Wear Model" and SPE11947 Glowka and Stone "Thermal Response of Polycrystalline Diamond Compact Cutters Under Simulated Downhole Conditions" the disclosures of which are incorporated by reference in their entirety. It follows that a layer of tungsten carbide, or any other material with a lower thermal conductivity than diamond that is pressed onto the face of a PDC diamond layer, will act as a thermal blanket throughout the life of the outer layer which in all likelihood will match the useful life of the diamond layer.
- It has been demonstrated that the HPHT process of bonding diamond and tungsten carbide leaves residual stresses at the interface.
- It has been demonstrated that cracking caused by impact, or by residual stresses in the bonded tungsten carbide can propagate into the diamond layer leading to macro chipping and failure of the diamond tip.
- It is known that backrakes in the range of 10° to 25° are best for attacking rock formations while backrakes of 2° to 7° are best for machining metals. It follows that cutters wherein a planar tungsten carbide layer, or other material has been flatly pressed against the diamond layer of a PDC cutter will by definition have the same backrake angle as the underlying cutter. When deployed on a mill drill tool these cutters will by definition have backrakes that are non-optimized for either metal machining or rock cutting.
- It has been demonstrated that even when a casing shoe bit that is primarily constructed of non-ferrous material is drilled out the tungsten carbide substrates of the PDC cutters deployed on the casing shoe bit can damage the PDC cutters of the bit being used to accomplish the drill out. This can occur even if an overexposed cutting structure of tungsten carbide is deployed on the drill out bit because the freed PDC cutters of the casing shoe bit can roll around underneath the drill out bit and can readily impact and damage the PDC cutters of the drill out bit by impacting the face of the PDC cutters.
- It has been demonstrated that all drill out applications including float equipment, shoe tracks, casing shoes, casing reamers, casing bits, stage cementing equipment, one-trip or disposable motors or turbines, or exit windows may have damaging effects on standard PDC bits. This continues to be the case even when great efforts are made in design and material substitutions to make the equipment more drill out friendly. The use of aluminum, phenolic, and other material has been helpful in limiting PDC bit damage but has left open the possibility of damage that can reduce the performance and useful life of a PDC bit in the drilling of formation after the drill out has occurred.

Evaluating the key points provided above demonstrates that the solutions of the prior art discussed above all embody significant design or construction compromises that substantially reduce the potential performance of the drill bit in the drilling of the formation, where it is going to spend the vast majority of its life whether measured in rotating hours or distance drilled. The prior art solutions require invasive modifications to the bit's design layout or the substitution of specialty cutters that are by definition non-optimized for formation cutting.

What is needed is a solution that allows for the use of standard PDC cutters, and formation optimized PDC bit designs without creating long-lived bearing areas. The solution should be capable of readily being retrofitted onto existing drill bits or drill bit designs and offer substantial cutter tip and cutter face protection, effective and rapid milling, and predictable and complete detachment from the bit or the cutters of the bit early in the course of the post casing/casing-associated equipment milling and drilling.

SUMMARY

A cap (such as a tungsten carbide cap, a tungsten carbide or CBN tipped cap, or a similar fitted cap) made of a suitable material is capable of being fitted as an integral part of the existing PDC cutting structure of a standard PDC drill bit. The cap is mounted to a PDC cutter which comprises a diamond face and underlying tungsten carbide substrate. The cap may cover, without directly bonding to, substantially all of the diamond face of the PDC cutter. Alternatively, the cap may cover, without directly bonding to, more than 50% of the diamond face of the PDC cutter. Alternatively, the cap may cover, without directly bonding to, approximately 50% of the diamond face of the PDC cutter. Alternatively, the cap may cover, without directly bonding to, less than 50% of the diamond face of the PDC cutter. The cap is held in place on the PDC cutter through a bonding action between the cap and the tugsten carbide substrate of the PDC cutter. More specifically, a portion of the cap (other than the portion on the diamond face) is bonded to a portion of, or a majority of, the tungsten carbide substrate of the installed PDC cutter that is exposed outside of the drill bit body.

The cap may be fitted onto any PDC cutter which includes a diamond face mounted on a substrate (such as a tungsten carbide substrate) including a diamond face which is of any one of the following types: non-leached, shallow leached, deep leached, and resubstrated fully leached.

In an embodiment the caps are made of a high toughness, low abrasion resistant tungsten carbide material. Such tungsten carbide material may contain cobalt percentages in the 14-18% range.

In an alternative embodiment the caps are made primarily of steel (or nickel or titanium, or any other appropriate metal or alloy). In an embodiment, a cap of this material type may additionally be set with a tungsten carbide or CBN outer tip. Such a tungsten carbide or CBN outer tip may be brazed to the metal base cap, or mounted thereto with a fastener (such as a screw secured through use of a tapped hole on the face of the metal base cap). Alternatively, the tungsten carbide or CBN outer tip may be hot pressed, high pressure pressed, LS bonded or otherwise adhered to the base cap material. In the embodiments where the outer tip is brazed or LS bonded to the metal base cap a high temperature braze material with a melting point above the melting point of the braze material to be used to mount the PDC cutters in the bit is recommended.

In a preferred embodiment the cap is secured to the substrate of the PDC cutter of the drill bit using a braze material with a lower melting point than was used to originally braze the PDC cutter into the body of the drill bit. For example, if the original brazing of the PDC cutters was performed using a braze material with a melting point in a range of 1300 degrees Fahrenheit to 1330 degrees Fahrenheit, then the protective cap would be brazed to the substrate of the PDC cutter using a brazing material with a melting point of less than 1250 degrees Fahrenheit.

In an alternative embodiment the caps can be pre-mounted on the PDC cutters using a high temperature braze material in an LS bonder or through other brazing methods as is known in the art. The pre-capped PDC cutters can then be brazed into a drill bit using known brazing methods and temperatures for brazing cutters into bits.

In a preferred embodiment the caps have faces that are inclined to produce a lower back rake angle relative to the milling target than the back rake angle of the underlying, capped PDC cutters.

In an embodiment, the outer face of the cap may be generally hemispherical in shape.

In a preferred embodiment the outer tip of the cap is offset from the outer tip of the PDC cutter it is protecting even when cutter back rake is taken into account. The offset comprises both a forward offset (in a direction perpendicular to the diamond table face) and a circumferential offset (in a radial direction). The offsets may, for example, be at least 0.030".

In another embodiment of the invention the front face of the cap may have a siderake angle that is different than the siderake of the underlying cutter. In other words the thickness of the front face portion of the cap may be greater on the outboard side of the cap that the inboard side of the cap, or vice versa.

In yet another embodiment the front face of the cap is forward offset (in a direction perpendicular to the diamond table face). However, the cutting tip of the cap is aligned with, or is positioned rearwardly of, the PDC tip. This offsetting of the tip of the cap with respect to the front face of the cap is accomplished through the use of an intervening bevel, ramp, arc, or step. In all instances the outer tip of the cap is in relatively close proximity to the cutting tip of the corresponding PDC cutter. This is advantageous in that when a bit is retrofitted with the caps the underlying force balance attributes of the bit are minimally affected. During milling or drill out the bit will benefit from the underlying force balanced layout. Another perceived advantage of this layout is that the effectiveness of the tip for milling purposes may be enhanced by falling slightly behind the PDC cutter tip. The outer cap tip will be better positioned to shear away metal surfaces than plow metal surfaces making for more efficient machining In a preferred embodiment the caps or outer tips of the caps incorporate chip breaker type grooves or depressions on their face to improve the milling/machining of casing or casing-associated equipment.

In all embodiments the caps are not bonded to the face or periphery of the PDC diamond layer but rather are bonded to the tungsten carbide substrate of the PDC cutter. PDC diamond is not wetable with standard braze material. A key aspect is that the face of the PDC cutter may be protected by a first portion of the cap without the cap being directly bonded to the face. In this implementation a second portion of the cap connected to (for example, integrally formed with) the first portion is secured to the tungsten carbide substrate of the PDC cutter by, for example, brazing.

In some embodiments the second portion of the cap is also bonded to the base of the cutter pocket below the face of the PDC cutter. In some embodiments shorter substrate PDC cutters are used to increase the bond area of the cap at the base of the cutter pocket. In some embodiments the pocket base is configured to increase the bonding area available to the cap at the same location.

In a preferred embodiment the braze material used to braze the cap to the cutter substrate also adheres to the inner surfaces of the first portion of the cap that are adjacent to the face and periphery of the PDC diamond layer. This braze material, while not functioning to secure the first portion of the cap to the diamond layer face, nonetheless provides a thin cushioning layer to limit the transfer of impact loads to the diamond layer while the cap is milling casing or casing-associated equipment.

In a preferred embodiment the cap incorporates holes or slots that improve the flow of braze material to the inner mating faces of the cap during installation. In a preferred embodiment these same holes or slots are configured to accelerate the disintegration and shedding of the cap, especially the first portion, after the milling is completed and as the cap begins to encounter rock formation.

In some embodiments serrations or grooves are also employed in the configuration of the cap to improve milling performance and to create predetermined fracture planes to better allow the cap to disintegrate at the commencement of formation drilling. Grooves or serrations on the cap also improve cooling and cleaning of the cap during milling operations.

In some embodiments the cap may be deployed on upreaming or backreaming sections of the drill bit to enhance the ability of the bit to mill back through milling debris, whipstock attachment equipment, or pull back through a casing window or drilled casing-associated equipment.

The cap fulfills the criteria set forth in the preceding background section in that it does not alter the bit design or selection for the formation to be drilled. It does not alter the underlying force balancing of the bit. It further leaves little or no bearing surfaces to reduce penetration rate when drilling the formation. The cap only minimally acts as a thermal insulator for part of the diamond face and then only when the cap is still intact. The cap is not bonded to the diamond face and therefore is not prone to transmit stress cracking into the diamond face. The cap does not interfere with the overall hydraulic configuration of the bit and has a minimal affect on bit hydraulics which diminishes as the cap deteriorates and is shed during formation drilling. The cap does not require special PDC cutters, or special non-cylindrical add on cutter substrates. The cap does not require mixes of diamond with other superabrasive materials to allow for milling. The cap enables the PDC bit to get through a milling step without increasing the likelihood of cutter tip rounding as can be the case with thin layers of tungsten carbide or other non-diamond material bonded to the face of the PDC cutters. The cap protects the tip of the PDC cutter from being damaged by freed PDC cutters, or impregnated segments, or other metallic debris produced during the drill out of casing-associated equipment.

DETAILED DESCRIPTION

Figure 1:
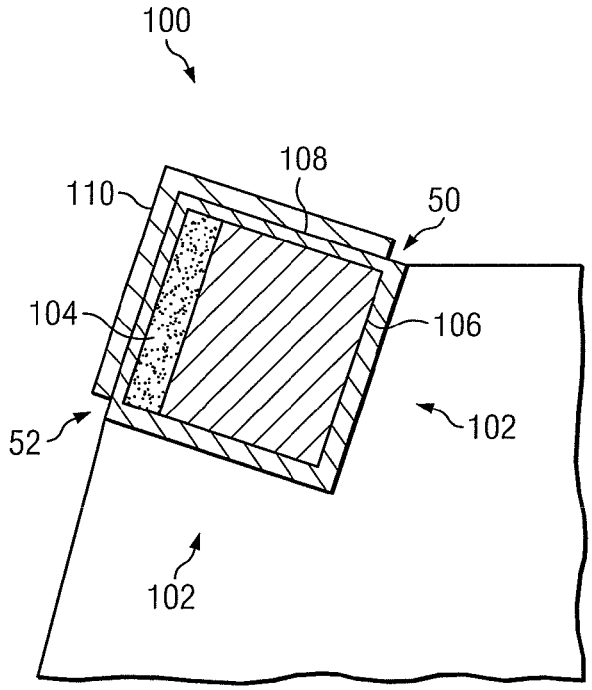
FIG. 1 shows a side view of a PDC cutter.
Figure 13:
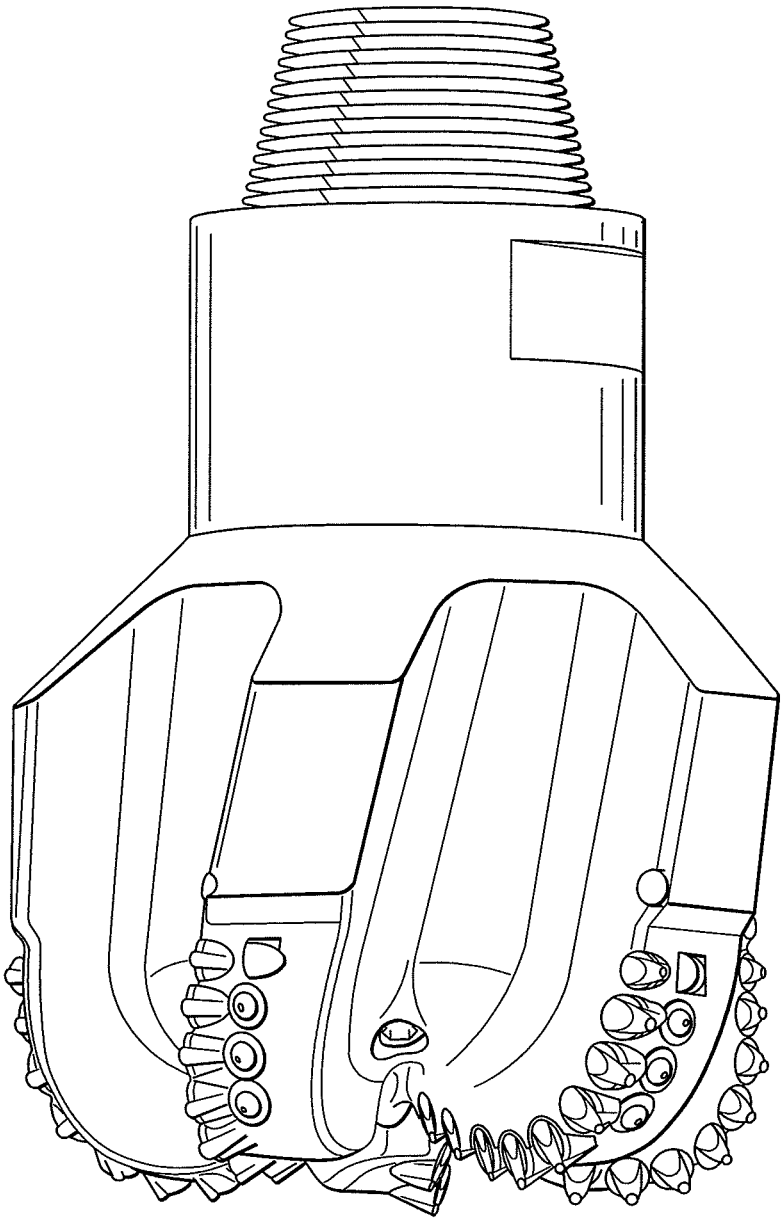
FIG. 13 shows a drill/mill bit including cutters with caps.

Reference is now made to FIG. 1 which shows a side view of a PDC cutter 100 installed in a pocket 102 of a drill/mill bit (like that shown in FIG. 13). The PDC cutter 100 comprises a diamond table layer 104 (or diamond face) and an underlying substrate 106 which may be made of a tungsten carbide material. The cutter pocket 102 is formed in a bit body which may be made of tungsten carbide in a matrix. The diamond table layer 104 may be non-leached, shallow leached, deep leached, or resubstrated fully leached, as desired. The configuration of PDC cutters and drill bit bodies with pockets is well known to those skilled in the art and will not be described in further detail except as is necessary to understand the present invention.

The PDC cutter 100 is typically secured within the cutter pocket 102 by brazing, although other methods may be used. The braze material 108 used to secure the PDC cutter 100 within the pocket 102 typically has a melting point in a range of 1300 degrees Fahrenheit to 1330 degrees Fahrenheit. The thickness of the braze material illustrated in FIG. 1 is shown over-scale in order to make its location and presence clear.

FIG. 1 further shows a cap 110 which has been installed on the PDC cutter 100. It will be understood that the cap 110 can, in a first implementation, be installed on the PDC cutter 100 after the PDC cutter has been secured to the cutter pocket 102 of the bit body. Alternatively, in a second implementation, the cap 110 is installed on the PDC cutter 100 before securing the combined cutter-cap assembly to the cutter pocket 102 of the bit body. Thus, the first implementation represents, for example, a retrofitting of a manufactured PDC drill bit to include a cap on desired ones of the included PDC cutters. Conversely, the second implementation represents, for example, the fabrication of a new PDC drill bit to include a capped PDC cutter at selected locations.

FIG. 1 specifically illustrates the use of a tungsten carbide cap (i.e., a cap made from tungsten carbide material). The material for the cap 110 may comprise a high toughness, low abrasion resistant tungsten carbide material, for example, a tungsten carbide material containing cobalt percentages in the 14-18% range. The cap 110 may have any desired shape, and several different shapes and configurations are discussed herein. Alternatively, as will be discussed in more detail herein, the cap 110 may alternatively be made of a metal (or metal alloy) material. Still further, that metal/metal alloy cap 110 may include a tungsten carbide or CBN tip. The cap 110 may alternatively be made of another suitable material of choice (non-limiting examples of materials for the cap include: steel, titanium, nickel and molybdenum).

The cap 110 is held in place on the PDC cutter 100 through a bonding action between the cap and the substrate 106 of the PDC cutter. More specifically, a portion of the cap 110 is bonded to a portion of, or a majority of, the substrate 106 of the installed PDC cutter that is exposed outside of the drill bit body (i.e., outside of the cutter pocket 102). The cap 110 is attached to the PDC cutter 100, in one implementation, using brazing to the substrate (a tungsten carbide substrate, for example). The braze material 108 used to secure the cap to at least the substrate of the PDC cutter typically has a melting point of less than 1250 degrees Fahrenheit (and is thus less than the melting point range of 1300 degrees Fahrenheit to 1330 degrees Fahrenheit for the brazing material used to secure the PDC cutter within the cutter pocket). This allows the cap 110 to be brazed to an already installed cutter without risking loosening the installed cutter from the pocket 102 during cap installation. The thickness of the braze material illustrated in FIG. 1 is shown over-scale in order to make its location and presence clear.

Preferably, the cap 110 is not brazed (i.e., is not attached) to the diamond table layer 104 of the PDC cutter 100. Rather, a first portion of the cap 110 over the front face of the diamond table layer 104 of the PDC cutter simply rests adjacent to that face, while a second portion of the cap over the substrate 106 is secured to that substrate by bonding. In this context, it is recognized that PDC diamond is not wetable with standard braze material. It is important that the diamond table face of the PDC cutter be protected by the cap without the cap being directly bonded to the face. The second portion of the cap 110 adjacent the substrate 106 of the PDC cutter 100, which is brazed and attached to the substrate material, may further be attached through brazing to the bit body in an area at the back of the cutter pocket (see, at reference 50). The first portion of the cap may also be attached through brazing to the cutter pocket (more specifically, the base of the cutter pocket below the face of the PDC cutter, see at reference 52). In some embodiments shorter substrate PDC cutters are used to increase the bond area of the cap at the base of the cutter pocket. In some embodiments the pocket base is configured to increase the bonding area available to the cap at the same location.

Some braze material 108 may advantageously be present between the cap 110 and the front face of the diamond table layer 104 of the PDC cutter 100, but this material does not serve to secure the cap to the diamond table layer. In a preferred embodiment, the braze material used to braze the cap to the cutter substrate also adheres to the inner surfaces of the cap that are adjacent to the diamond table face and periphery of the PDC diamond layer. This braze material provides a thin cushioning layer to limit the transfer of impact loads to the diamond layer while the caps are in use for milling casing or casing-associated equipment. Once the milling operation is completed, and the drill bit begins formation drilling, the cap (at least over the diamond table face) wears or breaks away so as to allow the diamond table to function as the primary cutting structure. In this way, the drill bit can be first used for milling (with the cap) and then used for drilling (with the diamond table), thus obviating the need to use and then pull a specialized milling bit from the hole.

In an alternative embodiment the cap 110 can be pre-mounted on the PDC cutter 100 using a high temperature braze material 108 in an LS bonder or through other brazing methods as is known in the art. The pre-capped PDC cutter can then be brazed into the cutter pocket 102 of a drill bit using known brazing methods and temperatures for brazing cutters into bits.

With respect to the shape and configuration of the cap 110, the cap may cover, without directly bonding to, substantially all of the diamond face 104 of the PDC cutter 100. Alternatively, the cap 110 may cover, without directly bonding to, more than 50% of the diamond face 104 of the PDC cutter 100. Alternatively, the cap 11 may cover, without directly bonding to, approximately 50% of the diamond face 104 of the PDC cutter 100. Alternatively, the cap 110 may cover, without directly bonding to, less than 50% of the diamond face 104 of the PDC cutter 100. Examples of different shapes with different covering percentages are shown in FIGS. 2 and 3.

Figure 2:
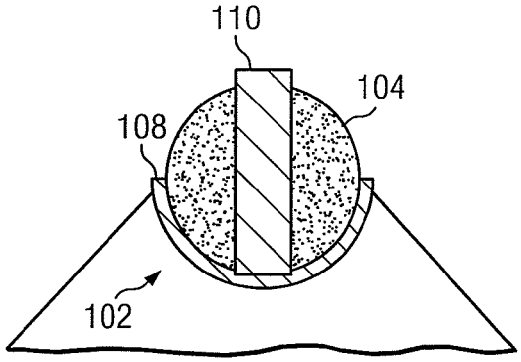
FIGS. 2-5 illustrate different shapes for the portion of a cap used on the PDC cutter.
Figure 3:
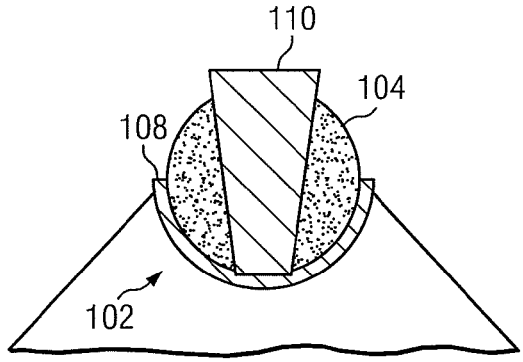

FIG. 2 illustrates a rectangular shape for the portion of the cap 110 which overlies the diamond face 104 of the PDC cutter 100. FIG. 3 illustrates a trapezoidal shape for the portion of the cap 110 which overlies the diamond face 104 of the PDC cutter 100. FIGS. 2 and 3 are end views looking towards the diamond face down the longitudinal axis of the PDC cutter. Again, in FIGS. 2 and 3 the thickness of the braze material for securing the PDC cutter within the cutter pocket has been exaggerated for clarity.

Other geometric shapes may be used to provide more or less or different coverage of the diamond face. See, for example, FIGS. 4 and 5.

Figure 4:
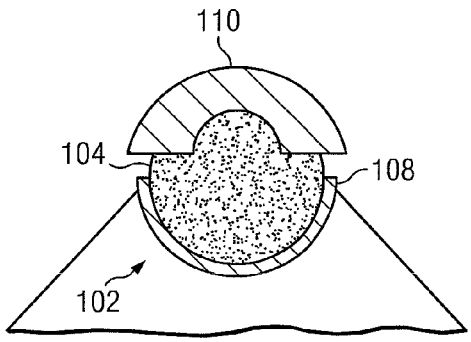
Figure 5:
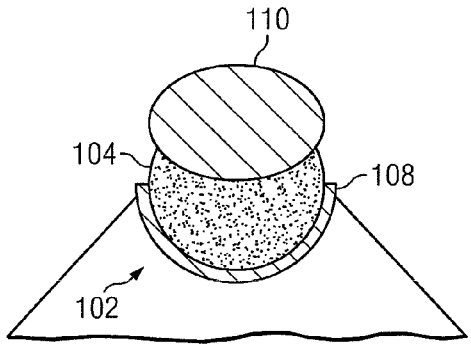

FIG. 4 illustrates a curved segment (eyebrow) shape for the portion of the cap 110 which overlies the diamond face 104 of the PDC cutter 100. FIG. 5 illustrates an oval or elliptical shape for the portion of the cap 110 which overlies the diamond face 104 of the PDC cutter 100. FIGS. 4 and 5 are end views looking towards the diamond face down the longitudinal axis of the PDC cutter. Again, in FIGS. 4 and 5 the thickness of the braze material for securing the PDC cutter within the cutter pocket has been exaggerated for clarity.

Figure 6:
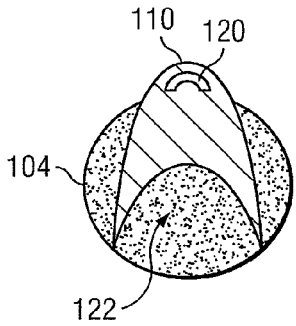
FIGS. 6 and 7 illustrate a chip breaker type groove or depression formed in the front face of the cap.
Figure 7:
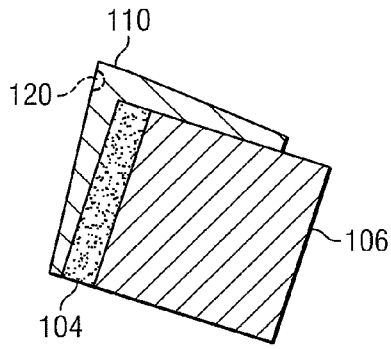

In a preferred embodiment the caps 110 have faces that are inclined to produce a lower back rake angle relative to the milling target than the back rake angle of the underlying PDC cutters 100. This is illustrated in FIGS. 6 and 7, wherein FIG. 6 shows an end view and FIG. 7 shows a side view of the implementation. Although FIG. 6 shows yet another different shape for the cap, it will be recognized that the differently inclined face of the cap (with respect to the diamond table) as shown in FIG. 7 to provide a lower back rake angle is equally applicable to any desired cap shape including those shown above in FIGS. 1-5. The angular difference between the diamond table face and the cap front face may range from a few degrees to ten to twenty degrees.

FIGS. 6 and 7 further illustrate the optional presence of a chip breaker 120 type groove or depression formed in the front face of the cap 110 near the cutting end at its outer tip. This structure may improve performance when milling/machining of casing or casing-associated equipment. In an alternative embodiment, serrations or grooves may be in the configuration of the cap to not only improve milling performance but also create predetermined fracture planes to better allow the caps to disintegrate following the completion of milling operations and the commencement of formation drilling. Such grooves or serrations on the caps also improve cooling and cleaning of the caps during milling operations.

FIG. 6 further shows another shape configuration for the cap 110. In this case, the outer peripheral shape of the cap is a half-ellipse whose major axis is oriented towards the cutting tip. Alternatively, this half-ellipse shape could instead comprise a hemispherical shape. A cut out portion 122 is provided extending in from this half cutoff shape with the cut out portion having generally the same geometric shape as the outer peripheral shape of the cap.

Although not specifically illustrated in the foregoing FIGS. 1-7, it will be understood that the front face of the cap 110 may be formed to include a siderake angle that is different than the siderake of the underlying PDC cutter 100. In other words the thickness of the front face portion of the cap is greater on one side (for example, the outboard side) of the cap than the other side (for example, the inboard side) of the cap. This optional siderake feature is illustrated in FIG. 8 with the dotted line 160.

In a preferred embodiment the caps 110 incorporate holes or slots 130 that improve the flow of braze material to the inner mating faces of the caps when they are being installed. In a preferred embodiment these same holes or slots 130 are configured to accelerate the disintegration and shedding of the caps after the milling is completed and as the caps begin to encounter rock formation. This is illustrated in FIG. 8 which illustrates a side view of a cap 110 incorporating the holes/slots 130.

Figure 8:
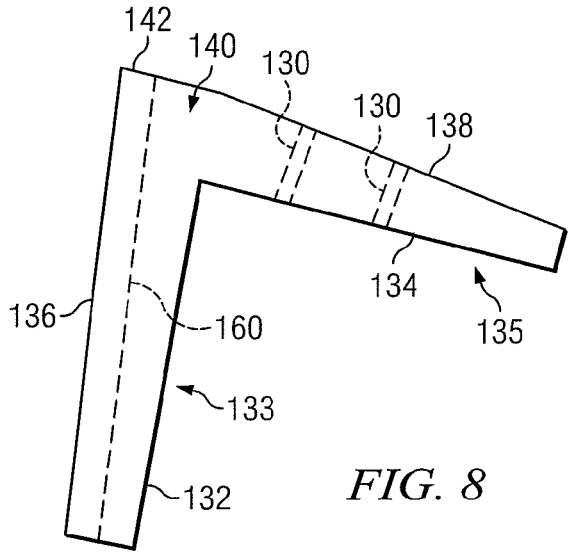
FIG. 8 illustrates an optional siderake feature for the cap.

FIG. 8 provides an enlarged side view of the cap structure. The cap 110 includes two inner surfaces which are set perpendicular to each other. A first of those perpendicular inner surfaces 132, associated with a first portion 133 of the cap, is positioned adjacent the diamond table face of the PDC cutter (not shown in FIG. 8). A second of those perpendicular inner surfaces 134, associated with a second portion 135 of the cap, is positioned adjacent the side of the PDC cutter. A front surface 136 of the cap is set at an acute angle with respect to the first perpendicular surface 132 in order to provide for the desired back rake change in comparison to the back rake angle of the diamond table face. A side surface 138 of the cap is set at an acute angle with respect to the second perpendicular surface 134. The combination of the angled front and side surfaces 136 and 138 provides for a thickening of the cap towards a tip 140 where the first and second portions 133 and 135 of the cap 110 meet. In an implementation, the front and side surfaces 136 and 138 may meet at the tip 140 of the cap 110. Alternatively, as shown in FIG. 8, an additional surface 142, which is generally parallel to the second perpendicular surface 134, connects the angled front and side surfaces 136 and 138 at the tip portion of the cap. The cap is an integrally formed article comprising the first and second portions interconnected at the tip portion.

In a preferred embodiment the outer tip 140 of the cap is circumferentially forward of the outer tip of the PDC cutter it is protecting even when cutter back rake is taken into account. If a line normal to the bit profile is drawn through the cutting tip of the PDC and a line normal to the bit profile is drawn through the outer tip of the corresponding cutter cap then in this embodiment the lines are substantially parallel and the line through the outer tip of the cutter cap is offset from the line through the PDC cutter tip by a radial distance of at least 0.030". Also, in a preferred embodiment the outer tip of the cap is offset, in a direction normal to the diamond table face, from the cutter tip of the PDC cutter by a forward distance of at least 0.030".

Embodiments discussed above emphasize the use of tungsten carbide material for the cap. In an alternative embodiment, the caps are instead made primarily of steel (or nickel or titanium, or any other appropriate metal or alloy). Some milling operations are better performed with a metal, as opposed to a tungsten carbide, cap. Such a cap could have the shape and configuration as shown in FIG. 8.

Figure 9:
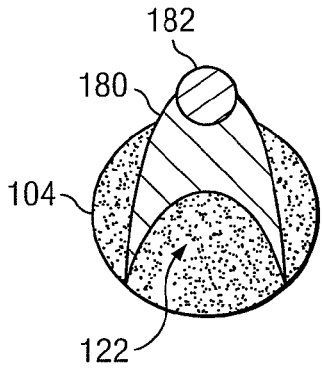
FIGS. 9 and 10 show an end view and a side view, respectively, of an alternative implementation for the cap.
Figure 10:
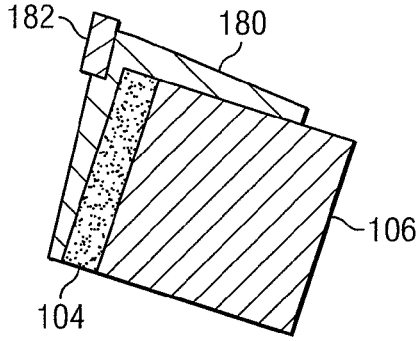

In an alternative embodiment, a cap 180 made of the metal/metal alloy material may additionally be set with a tungsten carbide or CBN outer tip 182. This implementation is illustrated in FIGS. 9 and 10, wherein FIG. 9 shows an end view and FIG. 10 shows a side view of the implementation. Such a tungsten carbide or CBN outer tip 182 may be brazed to the metal base cap 180 in the tip portion, or mounted thereto with a fastener (such as a screw secured through use of a tapped hole on the face of the metal base cap). Alternatively, the tungsten carbide or CBN outer tip 182 may be hot pressed, high pressure pressed, LS bonded or otherwise adhered to the base cap 180 material in the tip portion. In the embodiments where the outer tip is brazed or LS bonded to the metal base cap a high temperature braze material with a melting point above the melting point of the braze material to be used to mount the PDC cutters in the bit is recommended.

The cap configuration of FIGS. 9 and 10 may have the same forward and radial offsets as discussed above with respect to FIG. 8.

Figure 11:
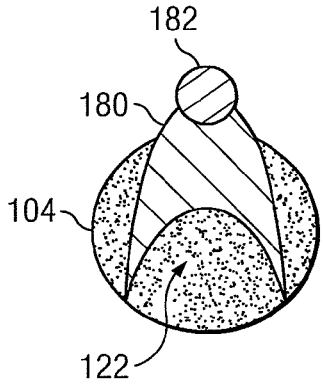
FIGS. 11 and 12 show an end view and a side view, respectively, of an alternative implementation for the cap.
Figure 12:
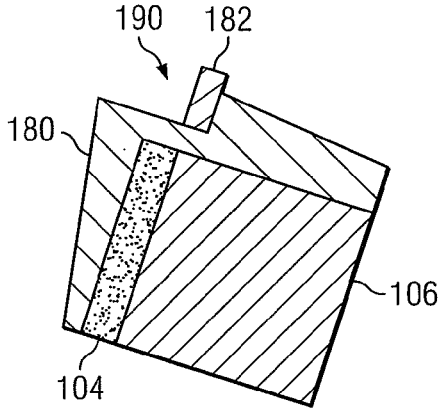

Reference is now made to FIGS. 11 and 12. In yet another embodiment the front face of the cap is offset from the diamond table face (for example, by a distance of 0.030") but the outermost tip of the cap is either radially aligned with the PDC tip or is offset rearwardly from the PDC tip (i.e., it falls some distance behind the cutting tip of the corresponding PDC cutter as indicated at reference 190). In either of these instances, the difference in the location of the outer tip of the cap from the front face of the tip is accomplished through the use of an intervening bevel, ramp, arc, or step. In all instances the outer tip of the cap is in relatively close proximity to the cutting tip of the corresponding PDC cutter than in any of the non-bonded standalone or augmented substrate cutting structures of the prior art. This is advantageous in that when a bit is retrofitted with the caps the underlying force balance attributes of the bit are minimally affected. During milling or drill out the bit will benefit from the underlying force balanced layout. Another perceived advantage of this layout is that the effectiveness of the tip for milling purposes may be enhanced by falling slightly behind the PDC cutter tip. The outer cap tip will be better positioned to shear away metal surfaces than plow metal surfaces making for more efficient machining.

In some embodiments the caps 110 may be deployed on upreaming or backreaming sections of the drill bit to enhance the ability of the bit to mill back through milling debris, whipstock attachment equipment, or pull back through a casing window or drilled casing-associated equipment.

It will be recognized that existing bits or bit designs can be readily retrofitted to accept the caps 110. The caps are robust enough to accomplish the milling tasks asked of them while being structurally predisposed to accelerated disintegration and shedding when milling is completed and the bit moved forward for drilling the formation. Bits retrofitted with the caps can be used to drill out steel bodied casing shoe bits or casing shoe bits constructed from other materials extending the casing shoe bit choices of casing drilling operations. Bits of the current invention can also be used in one trip mill drill systems where the bit is attached at the top of a whipstock for running in the hole.

The PDC drill bit including caps as described herein can be advantageously used in combined milling and formation drilling operations. In accordance therewith, a PDC cutter drill bit having a plurality a PDC cutters with certain ones of the cutters including a milling cap attached to the PDC cutter is provided for attachment to a drill string or other drilling equipment. The milling cap is configured for milling operations on a casing-associated component located in the hole but is not optimal for earth formation drilling operations. The drill bit is rotated and the milling cap on the drill bit used to perform a down hole milling operation on the casing-associated component. Drilling with the drill bit continues after milling of the casing-associated component to drill an underlying earth formation. Importantly, the same drill bit is being used, and thus there is no need to pull a milling bit from the hole before resuming formation drilling. The drilling of the earth formation causes the milling caps on the drill bit to be destroyed and thus reveal the diamond table surface of the PDC cutter which are then used in engaging the earth formation.

Referring now to FIG. 13, there is shown an example of a PDC drill/mill bit. This drill/mill bit includes a bit body which includes a plurality of cutter pockets (for example, positioned on radially extending blades). Each cutter pocket can support installation of a PDC cutter of the type described herein which may include a protective milling cap and thus permit the drill/mill bit to function initially as a milling tool (using the cap structures) and then as a drilling tool (using the underlying PDC diamond table after the cap has broken or worn away). The PDC drill/mill bit of FIG. 11 is shown in an exemplary manner as a full hole tool. It will be understood, however, that the drill/mill concept described herein using milling caps over PDC cutters is equally applicable to any downhole tool using PDC cutters. For example, the drill/mill concept could be used in connection with downhole tools comprising: bi-center bits, casing shoe bits, PDC reamers, PDC hole openers, expandable reamers, PDC set stabilizers, PDC set guide shoes and reaming guide shoes. More generally, the drill/mill concept is applicable to downhole tools expected to engage or come in contact with any "casing" or "casing-associated component" as previously described.

It will further be understood that the milling cap may need to be oriented on the PDC cutter (for example, with respect to installation in the cutter pocket of downhole tool) in such a way as to keep the PDC mill/drill bit (i.e., the downhole tool) from going over gage or over drift diameter (that is the diameter of the inside of the casing that can be "drifted," or the most constricted diameter of the inside of the casing).

Embodiments of the invention have been described and illustrated above. The invention is not limited to the disclosed embodiments.

What is claimed is:

1. Apparatus, comprising:

a cap structure configured for installation on a PDC cutter including a diamond table layer and an underlying substrate layer, the cap structure including a first portion shaped to overlay without being attached to a front face of the diamond table layer and a second portion extending perpendicularly from the first portion and shaped to overlay and be attached to at least a portion of an outer peripheral surface of the underlying substrate layer.

2. The apparatus of claim 1 further comprising the PDC cutter and a material for attaching the second portion of the cap structure to the outer peripheral surface of the PDC cutter without attaching the first portion of the cap structure to the front face of the diamond table layer.

3. The apparatus of claim 2 wherein the material for attaching is a brazing material and that brazing material is also present between the first portion of the cap structure and the front face of the diamond table layer to provide an intervening cushioning layer between the first portion of the cap structure and the front face of the diamond table layer, said intervening brazing material not functioning to attach the first portion of the cap structure to the front face of the diamond table layer.

4. The apparatus of claim 1 further comprising a brazing material for attaching the cap structure to the PDC cutter, and wherein the second portion of the cap structure includes at least one opening for flowing brazing material for attaching between the second portion of the cap structure and the outer peripheral surface.

5. The apparatus of claim 1 wherein the cap structure has a front face and wherein the front face of the cap structure is parallel to a rear face of the first portion which overlies the diamond table layer.

6. The apparatus of claim 1 wherein the cap structure has a front face and wherein the front face of the cap structure is not parallel to a rear face of the first portion which overlies the diamond table layer.

7. The apparatus of claim 6 wherein the not parallel front face of the cap structure provides for a different back rake angle than is provided by the front face of the diamond table layer.

8. The apparatus of claim 6 wherein the not parallel front face of the cap structure provides for a different side rake angle than is provided by the front face of the diamond table layer.

9. The apparatus of claim 1 wherein the cap structure further includes a cooling and cleaning structural feature.

10. The apparatus of claim 1 further comprising the PDC cutter and wherein the first portion of the cap structure covers more than about 50% of the front face of the diamond table layer.

11. The apparatus of claim 1 further comprising the PDC cutter and wherein the first portion of the cap structure covers less than about 50% of the front face of the diamond table layer.

12. The apparatus of claim 1 wherein the first portion of the cap structure has a shape selected from the group consisting of a rectangular shape, a trapazoidal shape, an oval shape, an elliptical shape, a curved segment shape, a half-elliptical shape, and a hemispherical shape.

13. The apparatus of claim 1 wherein the cap structure is made of a tungsten carbide material.

14. The apparatus of claim 1 wherein the cap structure is made of a metal/metal alloy material.

15. The apparatus of claim 14 wherein the cap structure further includes a tungsten carbide outer tip mounted to the metal/metal alloy cap material.

16. The apparatus of claim 14 wherein the cap structure further includes a CBN outer tip mounted to the metal/metal alloy cap material.

17. The apparatus of claim 1 wherein the cap structure further includes an outer tip made of a material different from the material from which a majority of the cap structure is formed.

18. The apparatus of claim 17 wherein the outer tip of the different material is offset rearwardly from a front face of the first portion of the cap structure.

19. The apparatus of claim 18 wherein the offset places the outer tip of the different material behind a rear face of the first portion which overlies the diamond table layer.

20. The apparatus of claim 17 wherein the outer tip of the different material is aligned in same plane with a front face of the first portion of the cap structure.

21. Apparatus comprising:

a PDC cutter including a diamond table layer and an underlying substrate layer, and a cap structure configured for installation on the PDC cutter, the cap structure including a first portion shaped to overlay without being attached to at least a portion of a front face of the diamond table layer and a second portion extending perpendicularly from the first portion and shaped to overlay and be attached to at least a portion of an outer peripheral surface of the underlying substrate layer, wherein the cap structure further includes a structural feature which accelerates disintegration and shedding of at least the not attached first portion of the cap structure from the PDC cutter.

22. A method, comprising:

providing a PDC cutter drill bit having a plurality a PDC cutters with certain ones of the cutters including a milling cap attached to the PDC cutter, but not a diamond table front surface of the PDC cutter, wherein the milling cap is configured for milling operations but is not optimal for earth formation drilling operations;

using the milling cap on the drill bit to perform a down hole milling operation; and continuing to drill an earth formation with the same drill bit following completion of the down hole milling operation, the drilling of the earth formation causing at least the portion of the milling cap not attached to the diamond table surface to be destroyed so as to reveal the diamond table front surface of the PDC cutter for use in engaging the earth formation.

23. The method of claim 22 further comprising forming structures in the milling cap which accelerate destruction of the milling cap in response to drill bit engagement of the earth formation.

24. A drill bit, comprising:

a bit body including a cutter pocket;

a PDC cutter having a diamond table layer and an underlying substrate layer, the PDC cutter being installed in cutter pocket; and a milling cap structure including a first portion overlying, but not attached to, a front face of the diamond table layer and a second portion connected to the first portion, the second portion being attached to an outer peripheral surface of an underlying substrate layer.

25. The drill bit of claim 24 wherein a first brazing material having a first melting point is used to mount the substrate layer to the cutter pocket and a second brazing material having a second melting point is used to mount the second portion of the milling cap to the substrate layer.

26. The drill bit of claim 25 wherein the second melting point is less than the first melting point.

27. The drill bit of claim 24 further comprising a cushioning material between the first portion of the milling cap and the diamond table layer.

28. The drill bit of claim 27 wherein the cushioning material is a brazing material used to mount the second portion of the milling cap to the substrate layer.

29. A drill bit comprising:

a bit body including a cutter pocket;

a PDC cutter having a diamond table layer and an underlying substrate layer, the PDC cutter being installed in cutter pocket;

a milling cap structure including a first portion overlying, but not attached to, a front face of the diamond table layer and a second portion connected to the first portion, the second portion being attached to an outer peripheral surface of an underlying substrate layer; and a structure formed in the milling cap which accelerates destruction of the milling cap.

30. The drill bit of claim 24 wherein a front face of the milling cap structure presents a different back rake angle than the front face of the diamond table layer.

31. The drill bit of claim 24 wherein a front face of the milling cap structure presents a different side rake angle than the front face of the diamond table layer.

* * * * *